US006223884B1

(12) United States Patent
Ronchi

(10) Patent No.: US 6,223,884 B1
(45) Date of Patent: May 1, 2001

(54) APPARATUS FOR AUTOMATICALLY FORMING ARRAYS OF CONTAINERS

(75) Inventor: Mario Ronchi, Cologno Monzese (Milan) (IT)

(73) Assignee: Ronchipack S.R.L., Gessate (IT)

( * ) Notice: Subject to any disclaimer, the term of this patent is extended or adjusted under 35 U.S.C. 154(b) by 0 days.

(21) Appl. No.: 09/311,198

(22) Filed: May 12, 1999

(51) Int. Cl.[7] ..... B65G 47/26
(52) U.S. Cl. ..... 198/457.01; 198/431; 198/456
(58) Field of Search ..... 198/431, 440, 198/456, 457.01

(56) References Cited

U.S. PATENT DOCUMENTS

| | | | |
|---|---|---|---|
| 3,917,053 | 11/1975 | Matsuyama . | |
| 5,501,064 | 3/1996 | Ingram et al. . | |
| 5,579,894 * | 12/1996 | Glazier et al. | 198/431 |
| 6,019,213 * | 2/2000 | Schubert | 198/431 X |

FOREIGN PATENT DOCUMENTS

| | | |
|---|---|---|
| 36 08 580A1 | 9/1987 | (DE) . |
| 42 28 868A1 | 6/1993 | (DE) . |
| 0 027 876 | 5/1981 | (EP) . |
| 0 709 315 A1 | 5/1996 | (EP) . |
| 0 884 254 A1 | 12/1998 | (EP) . |
| 1097328 | 3/1966 | (GB) . |

* cited by examiner

*Primary Examiner*—Christopher P. Ellis
*Assistant Examiner*—Gene O. Crawford
(74) *Attorney, Agent, or Firm*—Herbert Dubno

(57) ABSTRACT

An apparatus for forming arrays of containers supplied by a feeder belt. Receiver supports are provided for receiving the containers, which are integral with associated support elements. The support elements displaced from a receiving zone to a zone for releasing the rows of containers by means of associated actuating devices.

10 Claims, 3 Drawing Sheets

23b
22b
22b
21b
21
24
21
20
26a
26
24b
21
24
23a
21a
22a
24a
1
1
1
1
1
1
10
30

25
25a
23b
26
III
III
23a
25a

Fig. 3
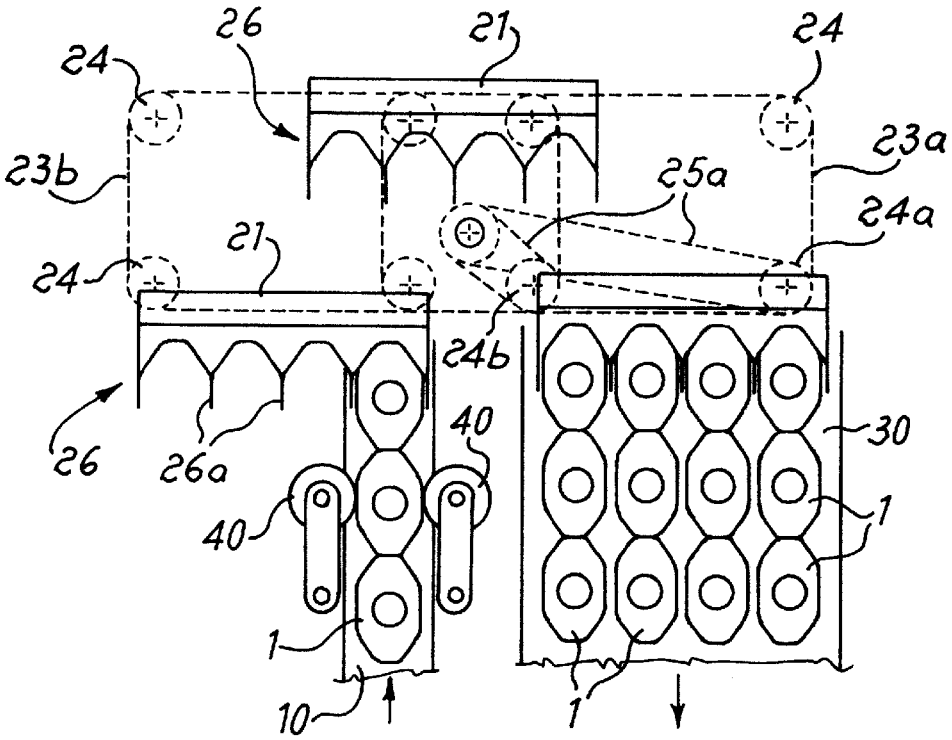
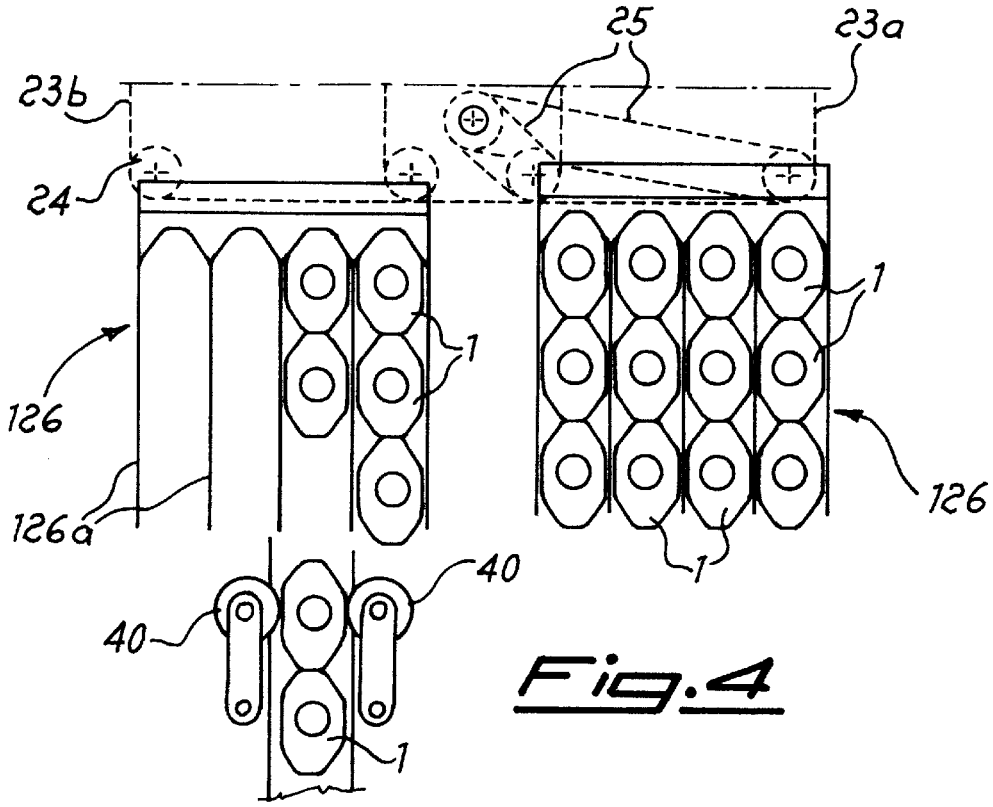
Fig. 4

APPARATUS FOR AUTOMATICALLY FORMING ARRAYS OF CONTAINERS

FIELD OF THE INVENTION

The present invention relates to an apparatus for automatically forming arrays of containers to be arranged inside boxes and the like.

BACKGROUND OF THE INVENTION

It is known that in the art relating to the packaging of containers of various shapes such as bottles, small receptacles and the like there is the need to align the containers in arrays consisting of a predefined number of rows and columns depending on the dimensions of the packaging box into which they must be inserted by means of a transportation head which removes the array of containers and places it in the box.

Automatic machines which are designed for this purpose are also known, the machines being substantially divided into two parts which are arranged alongside and synchronized with each other. In the first of these parts the arrays of containers are formed, while in the second part the box to be filled is formed, the connection between the said parts being effected by the head for gripping and inserting the array, already formed, inside the box.

More particularly, formation of the rows is performed by a belt for conveying containers arranged in a single line, the belt being equipped with means for effecting a movement in the transverse direction, which is designed to bring the end of the belt, at which the containers leave, into alignment with fixed receiving channels arranged above an auxiliary conveyor belt onto which the feeder belt unloads the containers for successive filling of each channel until the array to be boxed has been formed.

Although functional, these machines have drawbacks arising from the fact that it is not possible to achieve high working speeds during operation since the transportation head must in any case wait for formation of the array before being able to intervene.

In addition, in order to be able to increase the working speed, it is necessary to increase considerably the dimensions of the various parts with an obvious increase in costs and overall dimensions of the machine which must, however, be inserted in line with other apparatus and therefore cannot be expanded beyond certain limits.

Any need for re-tooling due to a change in size following variation in the shape and/or dimensions of the container to be transported also requires complicated operations for adjusting the guides which laterally delimit the receiving channels and the conveyor belt, as well as adjustment of the movement of the latter in the transverse direction. These operations increase greatly the downtime of the machine with a consequent reduction in the productivity thereof.

OBJECTS OF THE INVENTION

It is an object of the invention to provide an apparatus for forming arrays of containers such that they can removed and boxed, wherein is simple and inexpensive to manufacture and assemble and allows high production speeds and reduction in the inactive downtime of the transportation head of the downtime due to a size change following a variation in the shape and/or dimensions of the containers to be moved.

It is another object of the invention to provide an apparatus which allows the displacement of so-called "bundled" containers, i.e. ones which have been bound together in rows consisting of a predefined number of containers for example by means of a heat-shrinkable tape.

SUMMARY OF THE INVENTION

These technical problems are solved according to the present invention by an apparatus for forming arrays of containers supplied by means of a feeder belt, comprising means for receiving the containers, which are integral with associated support elements, said support elements being displaced from a receiving zone to a zone for releasing the rows of containers by means of associated actuating devices.

BRIEF DESCRIPTION OF THE DRAWING

The above and other objects, features, and advantages will become more readily apparent from the following description, reference being made to the accompanying drawing in which:

FIG. 3 is a cross-section along the plane indicated by III—III in FIG. 2;

FIG. 4 is a cross-section, similar to that of FIG. 3, of another embodiment of the apparatus according to FIG. 1;

SPECIFIC DESCRIPTION

Figure 1:
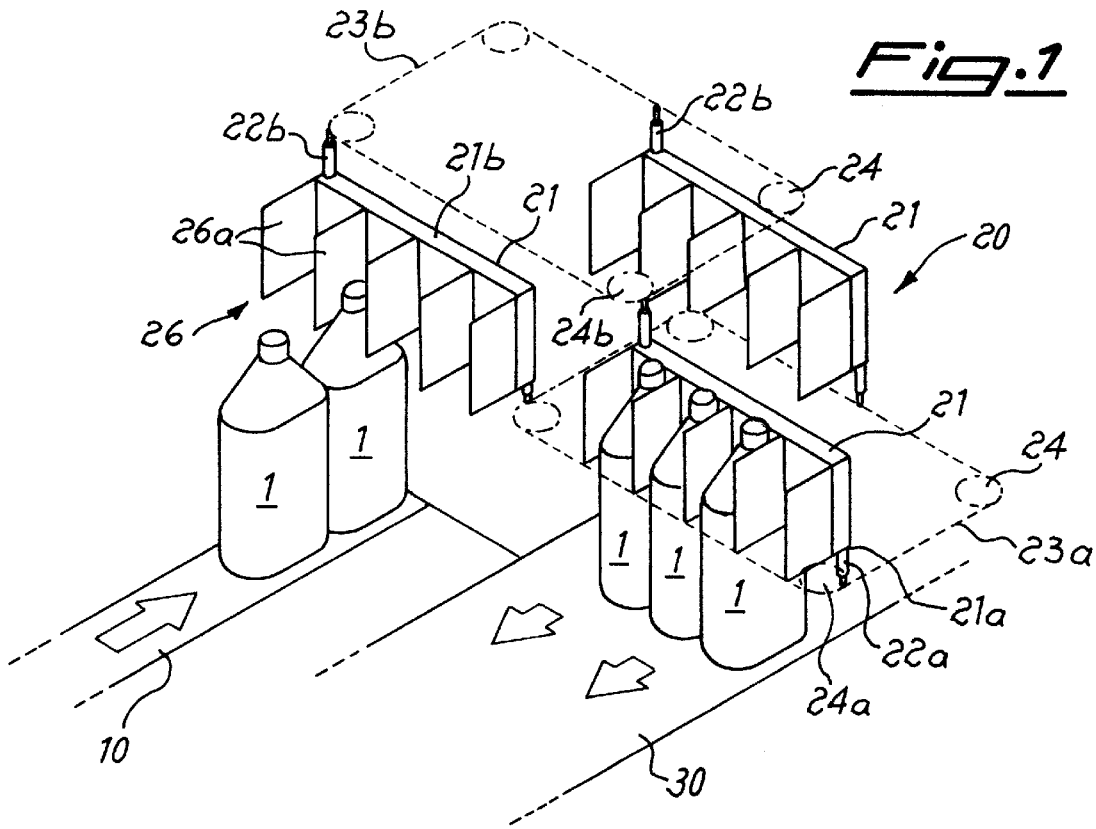
FIG. 1 is a schematic perspective view of a first embodiment of the apparatus according to the invention.
Figure 2:
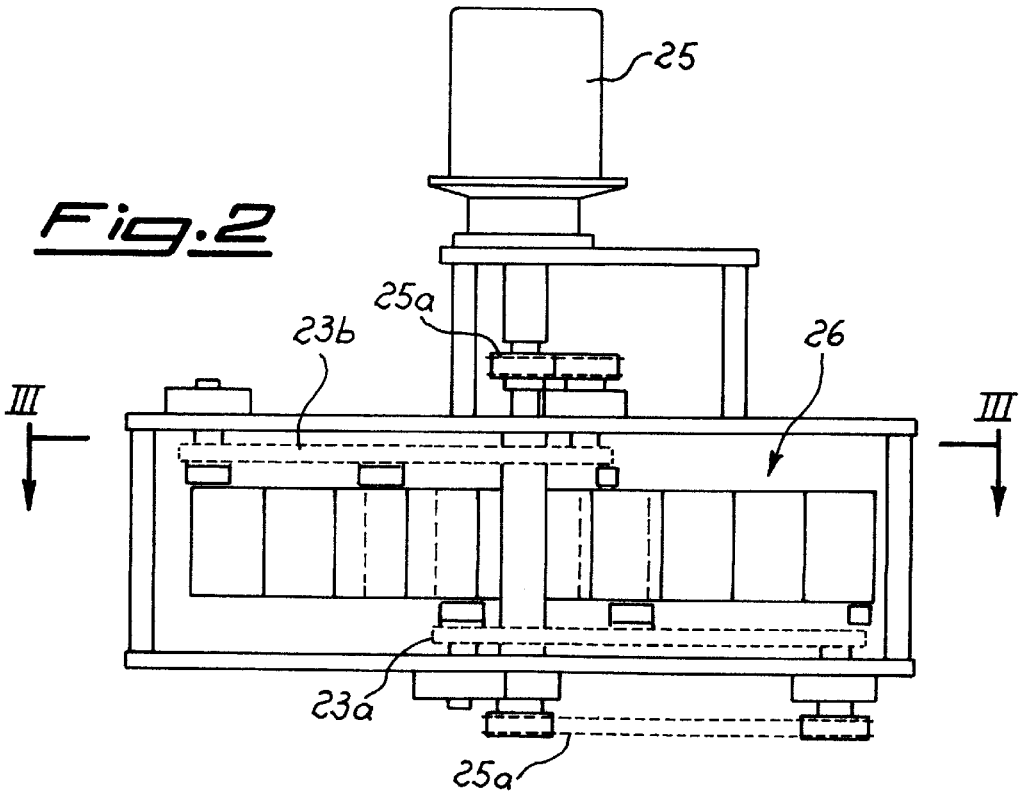
FIG. 2 is a front view of the movement mechanisms of the apparatus according to FIG. 1.

As shown in FIG. 1, the apparatus according to the invention essentially comprises a belt 10 for supplying the containers 1 to be moved, a device 20 for forming rows of containers 1, and a belt 30 for forming the array of containers 1.

This apparatus is normally inserted in an automatic packaging machine which also comprises means for forming and feeding packaging boxes and an arm with a head for gripping and transporting the array of containers into the box. Since such parts do not form the subject of the present invention, they are not shown or described.

In greater detail, the device for forming the rows of containers 1 comprises a support element 21 which is substantially in the form of an elongated parallelepiped, the bottom 21*a* of which is fixed, by means of a pin 22*a*, to a first chain 23*a* which is tensioned so as to extend substantially in the form of a rectangle between four pinions 24, one 24*a* of which is made to rotate by means of a motor 25 and associated transmission devices which are conventional per se and generally indicated by 25*a*.

Further transmission devices 25*a* also actuate a second pinion 24*b* of four pinions 24, around which a second chain 23*b* is tensioned, said chain being arranged at a higher level than the first chain and being parallel and partially superimposed on the latter.

The chain 23*b* has, connected to it, further pins 22*b* which are in turn fixed to the upper surface 21*b* of the support 21.

The two chains 23*a*, 23*b* also have fastened to them, in a similar manner, another two support elements 21 which are arranged so that they are substantially aligned along the front side of the chains and one is arranged parallel to the other ones along the rear side thereof. Each support 21 has, on its front face, seats 21*c* which are designed to engage with fast-coupling means 26*c* which are present on the rear face of rack-like elements 26 provided with numerous longitudinal partitions 26*a* (parallel to the longitudinal direction of the belt 10) and designed to contain in the transverse direction the containers 1 supplied by the belt 10.

In the example according to FIG. 1, the apparatus also comprises a second belt 30 for forming arrays. This belt 30 is arranged parallel to and alongside the feeder belt 10.

The belt 30 for forming the arrays has a step-type operation in a direction parallel and opposite to the feeding direction of the feeder belt 10, as will emerge more clearly from the description of operation of the apparatus.

The mode of operation of the apparatus, in the embodiment thereof described, is as follows:

- the belt 10 rotates continuously, supplying containers 1 to the rack 21;
- said rack is moved laterally by the motor 25 over intervals corresponding to the interaxial distance between two adjacent channels defined by the partitions 26*a*, this lateral movement being synchronized with the speed of the belt 10 so that a container 1 enters into each channel;
- once all the channels of the rack 26 have been filled, the latter is suddenly accelerated by the motor 25 so as to be brought as rapidly as possible into the zone for releasing the containers onto the belt 30 in order to form the arrays;
- once this position has been reached, rotation of the upper chain 23*b* causes the rack to be displaced towards the rear side, freeing the row of containers thus formed; and
- allowing the receiving belt 30 to move forwards by a step corresponding to the longitudinal dimension of the container;
- the acceleration imparted to the rack 26 for its lateral displacement at the same time brings into the loading position the rack which was previously located on the rear side of the chain 23*a*, preparing it for the stepwise lateral displacements which allow filling of its channels in accordance with the cycle already described.

The apparatus therefore continues to rotate in accordance with sequence described above, receiving rows of containers on the belt 30 which, moving forward in synchronism, forms successions of arrays which in each case are removed by the arm for gripping them and transporting them into the box which, with a synchronized movement, assumes a position ready for filling.

In order to increase further the speed of entry of the containers 1 into the channels of the rack 26, two rollers 40 (FIG. 3) are arranged in the vicinity of the zone where the containers leave the feeder belt 10, said rollers being made to rotate at high speed and being designed to come into contact with the opposite longitudinal surfaces of the container so as to accelerate the feeding movement thereof into the receiving channel.

In order to exploit further this high entry speed into the channels with the aim of further increasing the hourly productivity of the apparatus, the length, in the longitudinal direction, of the partitions 126*a* of the rack 126 is increased (FIG. 4) as to result in the formation of longitudinal channels containing a number of containers 1 equal to the number of rows envisaged for the array to be boxed.

In this way the array is formed at high speed by the feeder belt 10 and, when the rack 126 is accelerated so as to be displaced laterally into the zone for releasing the array, the latter is already formed and the gripping head is able to intervene immediately in order to grip and deposit the array into the associated box.

In a further variation of embodiment of the apparatus (FIG. 5), the rack 226 is formed by the external partitions 226*a* alone, which form a single internal channel having a width equivalent to that of the number of containers forming the row.

With this configuration it is possible to move at high speed also containers which are supplied by the feeder belt 210 already bundled, i.e. in rows which are already formed and retained by known means such as, for example, tape made of heat-shrinkable material 280; as shown in the example according to FIG. 4, the array is formed by the feeder belt 110 which, in this case, will have transverse dimensions which are suitably increased.

Figure 5:
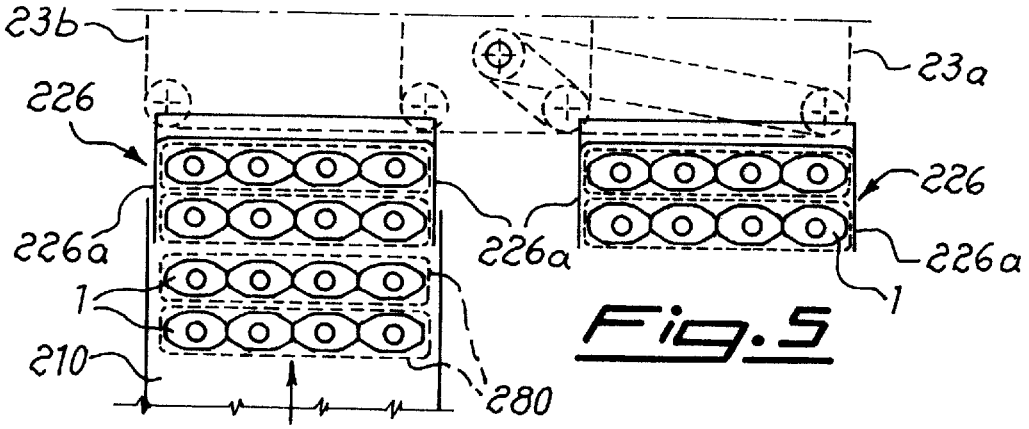
FIG. 5 shows a cross-section, similar to the preceding ones, of a further embodiment of the apparatus which is designed to move containers bundled in transverse rows with respect to the direction of feeding of the feeder belt.
Figure 6:
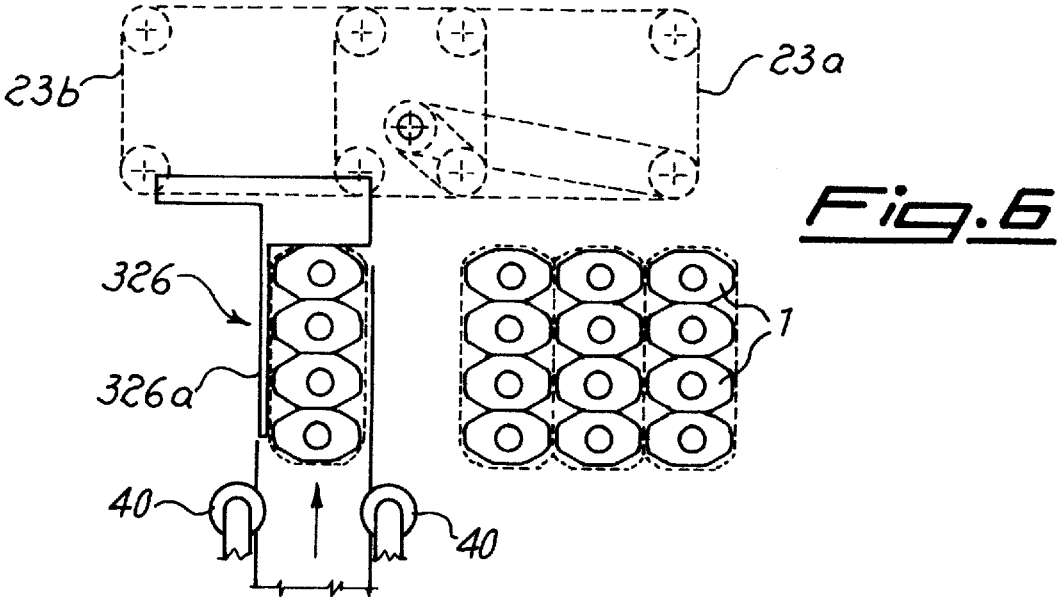
FIG. 6 shows a simplified embodiment of the apparatus according to the invention which is suitable for containers bundled in rows parallel to the direction of feeding of the feeder belt.

In the example according to FIG. 5, the containers are bundled in rows oriented in a transverse direction with respect to the feeding direction (rows already formed). It is possible, however, for the bundles to be supplied with an orientation parallel to the feeding direction (columns already formed); in this case, the configuration of the apparatus already described in relation to FIG. 4 is still applicable.

In the case of containers which are bundled and supplied in rows it is also possible to simplify further the rack 326 by reducing it to a single partition 326*a* which is substantially in the form of an "overturned L" which pushes each line of containers into the zone for formation of the array, which, in this case, is formed in a transverse direction for the columns and not in the longitudinal direction for rows, the latter being already pre-formed in the bundle. In this configuration the chains perform an alternating rectilinear movement so as to cause displacement of the rack only forwards and backwards without performing a complete revolution from the rear side; the synchronization of the movements envisages, moreover, that the rollers 40 act alternately as accelerators and as means for stopping the line of containers so as to allow the rack to return without interference.

Figure 7:
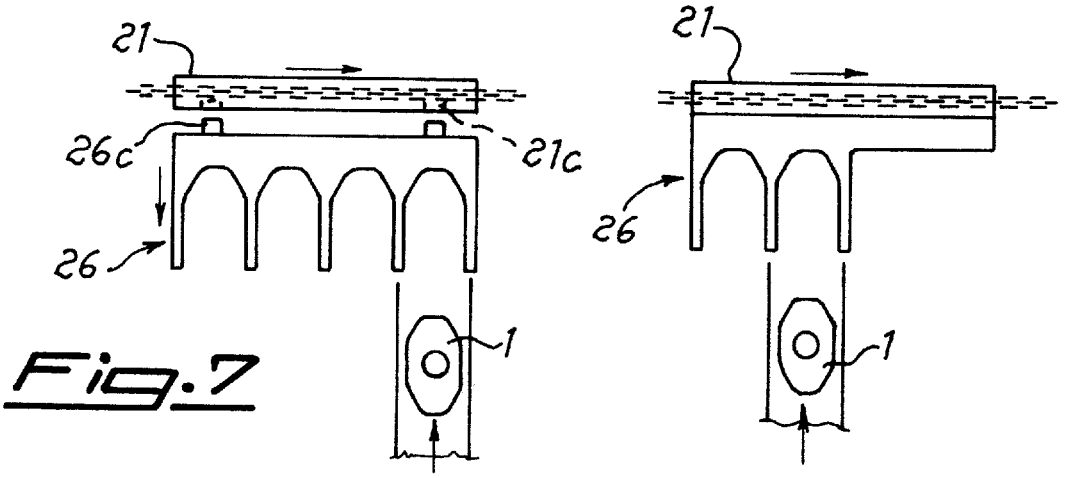
FIG. 7 is a schematic view of the size-changing sequence for rows with a smaller number of containers.

Finally, FIG. 7 shows in schematic form a size-changing operation of the apparatus; in order to perform said operation, it is sufficient to extract the rack from the support 21, by means of the fast-coupling device 26*a*, and replace it with another one which has a size depending on the shape and dimensions of the new container to be moved. In particular, if the number of columns of containers must be reduced, the partitions on the right-hand side of the Figure are eliminated, so as to allow the rack to bring the first channel to be filled opposite the feeder belt without causing collision with the containers which are already aligned in the zone for formation of the array.

What is claimed is:

1. An apparatus for forming an array of containers, comprising:

- a feeder belt for feeding a succession of containers;
- a plurality of support elements configured to receive a plurality of said containers;
- transportation means connected to said support elements for displacing said support elements from a receiving zone in which each support element receives a plurality of said containers to a zone for releasing rows of said containers; and
- at least one pair of pins connecting each support element with said transportation means, said at least one pair of pins including at least one pin affixed to an upper surface of the respective support element and at least one pin affixed to a lower surface of the respective support element, said transportation means including upper and lower chains disposed respectively above and below said support elements, ends of the pins opposite the ends affixed to each upper surface and each lower surface of the respective support element being connected to the upper and lower chains respectively, each of said chains forming an endless loop around a plurality of pinions, at least one of the pinions being a driving pinion, said loops lying in respective planes and partially overlapping in plan view.

2. The apparatus defined in claim 1, further comprising a belt receiving said containers at said zone for releasing rows of said containers and synchronized with said feeder belt and feed transportation means.

3. The apparatus defined in claim 1 wherein said feeder belt receives bundles of said containers arranged in a direction parallel to a feeding direction of said feeder belt.

4. The apparatus defined in claim 1 wherein said containers are received by said feeder belt in the form of bundles of containers extending transversely with respect to a feeding direction of the feeder belt.

5. The apparatus defined in claim 1 wherein said support elements include respective supports provided with said pins and connected to said chains and receiving means provided with fast coupling elements for engagement with and disengagement from the respective support element, said receiving means including guides for receiving the plurality of containers.

6. The apparatus defined in claim 5 wherein each support has the configuration of a parallapiped provided with seats for engagement with the fast coupling elements of the receiving means.

7. The apparatus defined in claim 1 wherein said support elements are provided with longitudinal partitions delimiting channels for receiving the containers.

8. The apparatus defined in claim 7 wherein said longitudinal partitions have lengths equivalent to a length of a container.

9. The apparatus defined in claim 7 wherein said partitions have lengths equivalent to that of a plurality of containers arranged in a line.

10. The apparatus defined in claim 7 wherein said partitions on each support element define a single channel of predetermined width.

* * * * *